US005356312A

United States Patent [19]

Abe et al.

[11] Patent Number: 5,356,312

[45] Date of Patent: Oct. 18, 1994

[54] CONNECTOR WATERPROOFING STOPPER

[75] Inventors: Kimihiro Abe; Seiji Koumatsu, both of Shizuoka, Japan

[73] Assignee: Yazaki Corporation, Tokyo, Japan

[21] Appl. No.: 176,698

[22] Filed: Jan. 3, 1994

Related U.S. Application Data

[63] Continuation of Ser. No. 986,806, Dec. 8, 1992, abandoned.

[30] Foreign Application Priority Data

Dec. 9, 1991 [JP] Japan ..... 3-101114[U]

[51] Int. Cl.[5] ..... H01R 13/52

[52] U.S. Cl. ..... 439/587; 439/278

[58] Field of Search ..... 439/587–589, 439/556, 559, 274, 275, 278, 279

[56] References Cited

U.S. PATENT DOCUMENTS

| | | | |
|---|---|---|---|
| 2,705,308 | 3/1955 | Howard | 439/274 |
| 2,948,773 | 8/1960 | Hawes | 439/559 |
| 4,214,802 | 7/1980 | Otani et al. | 439/275 |
| 4,735,581 | 4/1988 | Endo et al. | 439/587 |
| 4,802,867 | 2/1989 | Palmer | 439/587 |
| 4,895,533 | 1/1990 | Yagi et al. | 439/587 |

FOREIGN PATENT DOCUMENTS 1121276 8/1989 Japan .

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A connector waterproofing stopper includes a tubular part which in turn has a seal portion in one half thereof and a connecting portion in the other half thereof. The connecting portion has an annular engaging rib in the end portion of the outer peripheral surface thereof. The annular engaging rib includes an engaging surface and, on the opposite side of the engaging surface, a tapered reinforcing portion which extends from the top portion of the annular engaging rib toward the axial direction of the connecting portion. When an external force to pull an electric wire is given to the annular engaging rib, the reinforcing portion prevents the annular engaging rib from inclining to thereby maintain the engagement between the engaging surface and an electric wire connecting terminal.

7 Claims, 3 Drawing Sheets

CONNECTOR WATERPROOFING STOPPER

This is a continuation of application Ser. No. 07/986,806, filed Dec. 8, 1992 now abandoned.

BACKGROUND OF THE INVENTION

The present invention relates to a connector waterproofing stopper for hermetically sealing and waterproofing a connector used to connect electric wires to each other.

The Japanese Utility Model Unexamined Publication No. Hei. 1-121276 discloses a connector waterproofing stopper A for hermetically sealing and waterproofing a connector as shown in FIGS. 6 and 7.

The connector waterproofing stopper A includes a tubular part 1 formed of a soft and elastic material such as rubber in a tubular shape, and a reinforcing member 2 which is connected integrally to the tubular part 1 for reinforcing the tubular part 1 partially.

The tubular part 1 defines an electric wire insertion hole 3 extending therethrough. The tubular part 1 includes in one half a seal portion 1*a* having an outer peripheral surface to be closely engaged with an inner peripheral surface of a connector housing and in the other half a connecting portion 1*b* to be grasped and pressed by staking portions of an electric wire connecting terminal. Further, an annular rib 6 for engagement with the staking portion is provided in the periphery of the end portion of the connecting portion 1*b*.

The annular engaging rib 6 has an engaging surface 6*a* which is disposed opposite to the seal portion 1*a* and which stands up almost at right angles from the outer peripheral surface of the tubular part 1 so as to be engaged with the end portions of the staking portions of the electric wire connecting terminal to prevent the connector waterproofing stopper A from slipping off therefrom.

The seal portion la has an ellipsoidal section so as to be closely engaged with the ellipsoidal inner peripheral surface 5 of the connector housing 4. Also, the seal portion 1*a* includes on the outer peripheral surface thereof, a gathered portion 7 to be brought into contact with an inner peripheral surface of a connector housing in an elastic compression manner, and, on the inner peripheral surface thereof, another gathered portion 9 to be brought into contact with a covered wire in an elastic compression manner.

The reinforcing member 2 is formed of a rigid material such as a synthetic resin material or the like. The member 2 includes an ellipsoidal base plate portion 10 with an electric wire insertion hole 11 formed in the center portion thereof. The member 2 also includes two leg portions 12 which are respectively projecting from the base plate portion 10 at both sides of the electric wire insertion hole 11. The leg portions 12 are respectively inserted into the seal portion 1*a* to reinforce the seal portion 1*a*.

The connector waterproofing stopper A thus constructed, is held together with the electric wire on the electric wire connecting terminal to hermetically seal and waterproof the inner peripheral surface of the connector housing and the electric wire from each other when the electric wire connecting terminal is retained in the housing.

SUMMARY OF THE INVENTION

The present invention was made to improve the above-mentioned conventional waterproofing stopper.

Accordingly, it is an object of the invention to provide an improved connector waterproofing stopper having an annular engaging rib which bears against a greater external force applied thereto to more fixedly hold the stopper onto the electric wire connecting terminal.

Another object of the present invention is to provide an arrangement of an annular engaging rib, which can reinforce the rib without increasing the volume thereof in comparison with that in the conventional one.

Still another object of the present invention is to provide an arrangement of an annular engaging rib, which positively prevents undesirable compressive and elastic deformation of the rib caused due to the external force applied thereto.

Yet another object of the present invention is to reinforce an annular engaging rib, which is integrally formed in a waterproofing stopper, without the use of a separate reinforcing member.

In attaining the above-noted and other objects, according to the invention, there is provided a connector waterproofing stopper including a tubular part which is formed of an elastic material such as rubber or the like and which defines an electric wire insertion hole extending therethrough. The tubular part includes, in one half thereof, a seal portion having an outer peripheral surface to be brought into tight contact with the inner wall surface of a connector housing and, in the other half thereof, a connecting portion to be tightly fastened by electric wire staking portions of an electric wire connecting terminal which is to be stored in the connector housing. An annular engaging rib is provided in the periphery of the outer surface of the connecting portion and, in the surface of the annular engaging rib that is opposed to the seal portion, there is provided an engaging surface which is engageable with the end portion of the electric wire staking portion. Also, on the opposite side of the engaging surface of the annular engaging rib, there is provided a tapered reinforcing portion which extends from the vicinity of the top of the annular engaging rib toward the axial direction of the connecting portion.

In the connector waterproofing stopper structured in the above-mentioned manner, on the opposite side of the engaging surface of the annular engaging rib, there is provided the tapered reinforcing portion extending from the vicinity of the top of the engaging annular rib toward the axial direction of the connecting portion. Owing to this arrangement, even if a great external force is caused on the waterproofing stopper, the annular engaging rib is not inclined down but can stand upright because it is supported by the tapered reinforcing portion. therefore, the engaging surface of the annular engaging rib can be kept engaged with the electric wire connecting terminal.

The tapered reinforcing portion is arranged such that it includes a tapered surface extending from the vicinity of the top of the annular engaging rib toward the axial direction of the connecting portion and also saves unnecessary portions not related to prevention of the flex deformation of the annular engaging rib. That is, the tapered reinforcing portion has a required minimum volume and, therefore, it provides no obstacle when the waterproofing stopper is assembled.

DETAILED DESCRIPTION OF THE PREFERRED EMBODIMENT OF THE INVENTION

Figure 1:
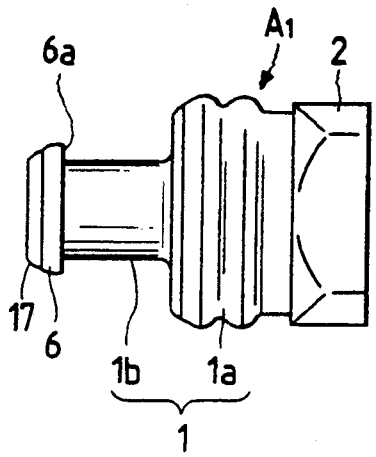
FIG. 1 is a side view of a connector waterproofing stopper $A_1$.

Now, description will be given hereinbelow of an embodiment of a connector waterproofing stopper according to the invention with reference to the accompanying drawings. In the drawings, the same components as in the above-mentioned conventional connector waterproofing stopper are given the same designations and the detailed description thereof is omitted here.

Figure 2:
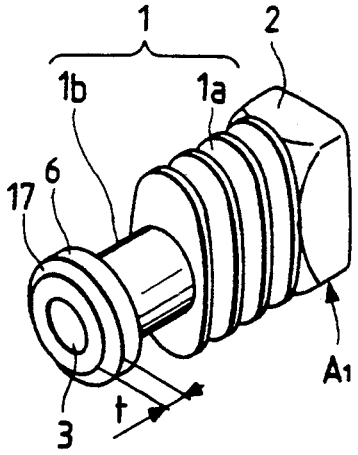
FIG. 2 is a perspective view of the connector waterproofing stopper $A_1$.

A connector waterproofing stopper $A_1$, as shown in FIG. 1 which is a side view thereof and in FIG. 2 which is a perspective view thereof, includes a tubular part 1 and a reinforcing member 2 which are formed integrally with each other. The tubular part 1 has an electric wire insertion hole 3 extending through the tubular part 1. Also, the tubular part 1 includes in one half thereof a seal portion 1*a* and in the other half thereof a connecting portion 1*b* which is to be grasped and pressed by staked portions 14. The connecting portion 1*b* is provided at the end portion thereof with an annular engaging rib 6 which extends along the periphery of the end portion. The annular engaging rib 6 has an engaging surface 6*a* which is confronted with the seal portion 1*a*, and a tapered reinforcing portion 17 on the opposite surface to the engaging surface 6*a*.

The tapered reinforcing portion 17 has a thickness t, FIG. 2, which is sufficiently large to prevent the flex deformation of the annular engaging rib 6. In order to save unnecessary portions which does not function to prevent the flex deformation of the annular engaging rib 6, the tapered surface extends from the vicinity of the top portion of the annular engaging rib 6 toward the axial direction of the connecting portion, so that the annular engaging rib 6 has the required minimum volume.

Due to the above structure, the volume of the connector waterproofing stopper $A_1$ is substantially equal to that of the conventional one in spite of the thickness t being increased. Also, since the tapered reinforcing portion 17 is decreased in height toward the end portion of the connecting portion, a covered wire can be inserted into the tubular part 1 with no difficulty. Therefore, the provision of the tapered reinforcing portion 17 does not adversely affect on the assembling operation of the waterproofing stopper $A_1$, or the like.

The seal portion 1*a* has an outer peripheral surface which is substantially identical in shape with the inner peripheral surface 5 of a connector housing 4. That is, the seal portion 1*a* has a gathered portion 7 in the outer peripheral surface thereof and also another gathered portion (not shown) in the inner peripheral surface thereof. In addition, similarly as in the conventional stoppers, the seal portion 1*a* is reinforced by the reinforcing member 2.

Figure 4:
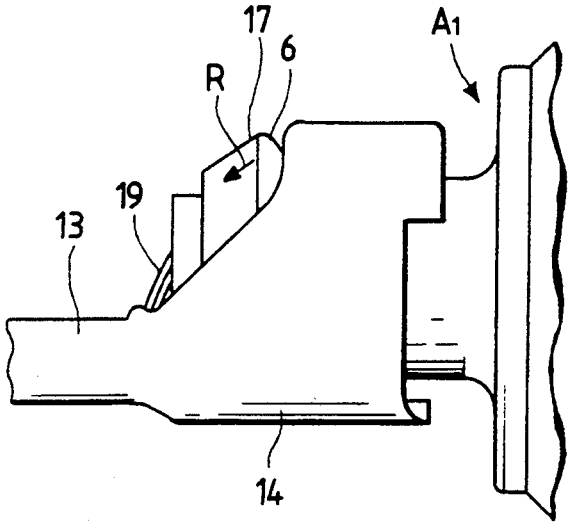
FIG. 4 is a side view of main portions of the connector waterproofing stopper $A_1$, explaining a state in which a tapered reinforcing portion prevents the flex deformation of an annular engaging rib.

The electric wire connecting terminal 13 includes the staking portions 14 which are used to grasp and press the outer peripheral surface of the connecting portion 1*b*, and electric wire conductor connecting portions 20 standing upright at both sides of a conductor which projects out from the leading end of the covered wire 8. As shown in FIG. 4, the staking portion includes a tapered coupling portion 14*a* so that the diameter increases gradually from the wire connecting portion 13*a* to the staking portion. In addition, reference numeral 18 designates a rear holder which prevents the terminal 13 from being removed backward with respect to housing and which is abuttable against the back surface of the waterproofing stopper $A_1$.

Figure 5:
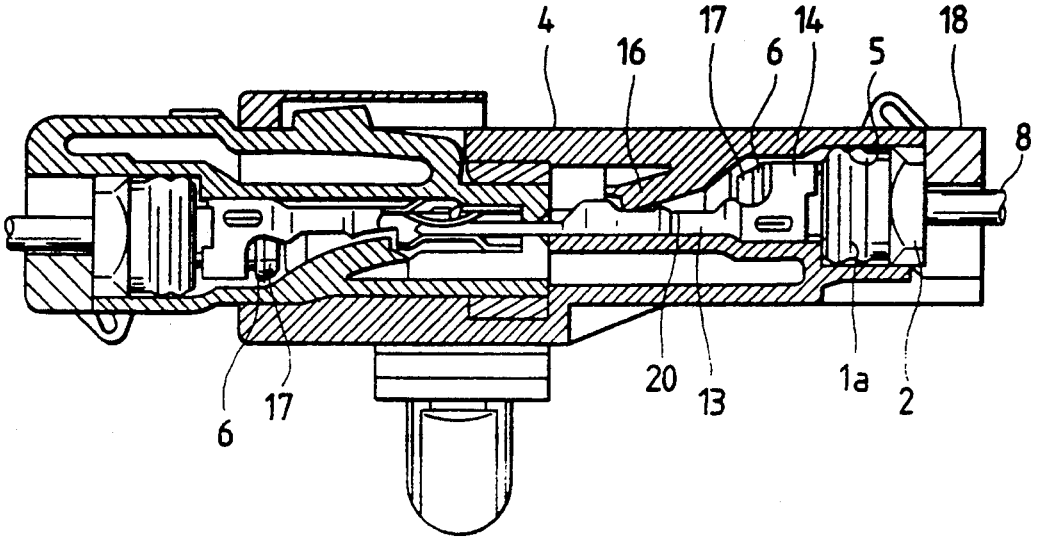
FIG. 5 is a longitudinal section view of a connector housing with the connector waterproofing stopper $A_1$ mounted thereto.
Figure 6:
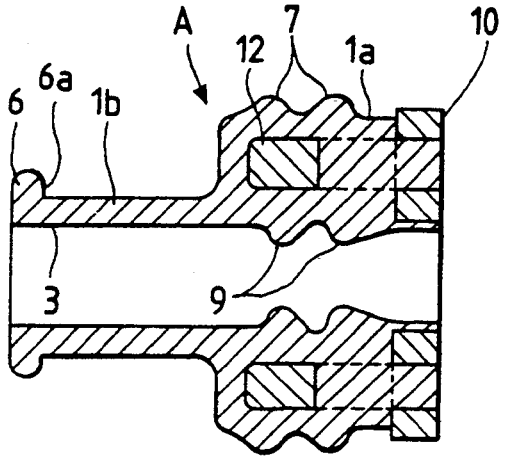
FIG. 6 PRIOR ART
FIG. 6 is a longitudinal section view of a conventional connector waterproofing stopper A.
Figure 7:
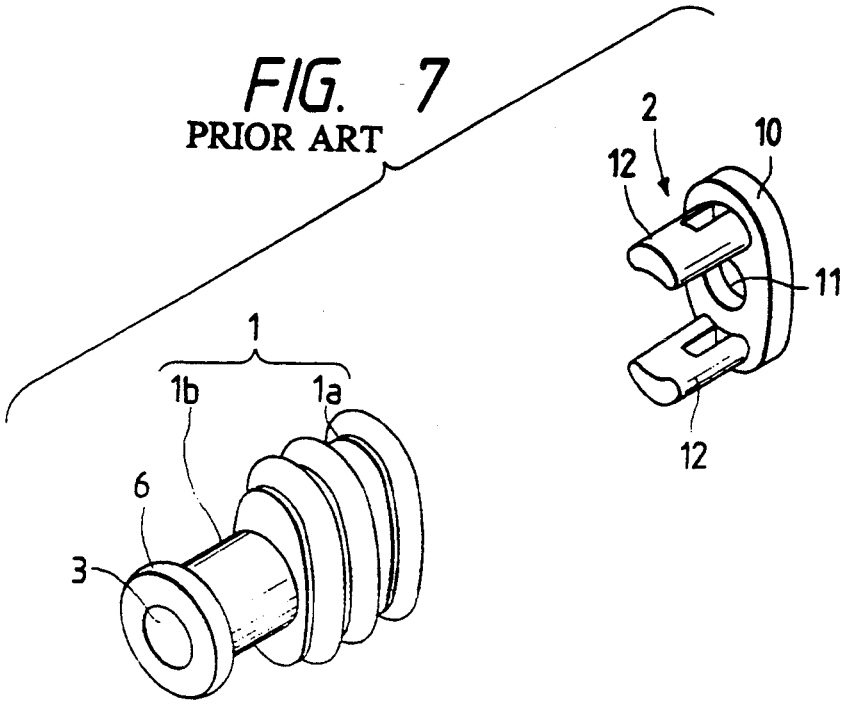
FIG. 7 PRIOR ART
FIG. 7 is an exploded perspective view of the conventional connector waterproofing stopper A.

Referring now to the operation of the connector waterproofing stopper $A_1$ constructed in the above-mentioned manner, after the covered wire 8 is inserted into the electric wire insertion hole 3, the staking portions 14 of the electric wire connecting terminal 13 is fastened to the connecting portion 1*b*, and the electric wire connecting terminal 13 inserted in the connector housing 4 is secured thereto by the retaining arm 16, so that the connector waterproofing stopper $A_1$ can hermetically seal and waterproof between the inner peripheral surface 5 of the connector housing 4 and the covered wire 8 (see FIG. 5).

Figure 3:
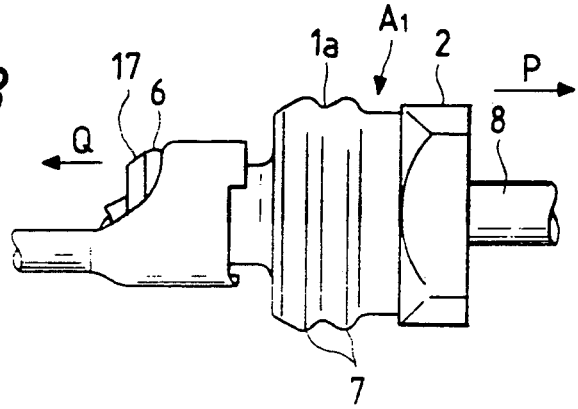
FIG. 3 is a side view of the connector waterproofing stopper $A_1$, explaining a state in which an external force is applied to an electric wire.

While the electric wire connecting terminal 13 with the covered wire 8 and waterproofing stopper $A_1$ mounted thereto is in transit, if the waterproofing stopper $A_1$ happens to strike other objects or if the waterproofing stopper $A_1$ happens to strike the end face of the connector housing 4 when it is inserted into the connector housing, an external force will be applied to the waterproofing stopper $A_1$ in a direction of an arrow P (see FIG. 3).

In this case, a force Q in the opposite direction to the external force P is applied to the engaging surface 6*a* in engagement with the staking portion 14. This force Q causes the staking portion to exert an obliquely extending force on the engaging surface portion, as indicated by arrow R. The tapered reinforcing portion 17 prevents the annular engaging rib 6 from inclining to thereby maintain the engagement between the engaging surface 6*a* and the electric wire connecting terminal 13. Therefore, it is possible to surely prevent the tubular part 1 from being slipped off from the terminal 13.

The tapered reinforcing portion 17 is constructed such that it has a shape which saves unnecessary portions not helpful for prevention of the flex deformation of the annular engaging rib 6 to thereby provide a necessary but minimum volume. Therefore, the whole area of the connector waterproofing stopper $A_1$ is substantially equal to that of the conventional stopper and also provision of the tapered reinforcing portion 17 provides no obstacle in assembling the waterproofing stopper $A_1$.

Due to the fact that the invention is structured in the above-mentioned manner, even if a great external force is given, there is eliminated the possibility that the connector waterproofing stopper may be slipped off, which improves the reliability of the connector waterproofing stopper.

What is claimed is:

1. A connector waterproofing stopper adapted to be clamped by electric wire staking portions of an electric wire connecting terminal together with a covered wire to seal between the covered wire and an inner wall surface of a connector housing accommodating the electric wire connecting terminal therein, said stopper comprising:

a tubular part formed of an elastic material with an electric wire insertion hole extending therethrough;

the tubular part including:

a seal portion with an outer surface adapted to be brought into tight contact with the inner wall surface of the connector housing;

a connecting portion adapted to be clamped by the electric wire staking portions; and an annular engaging rib extending radially outward from an end of said connecting portion, the annular engaging rib having an engaging surface portion for engagement with the electric wire staking portions and means for reinforcing the engagement of the annular engaging surface portion with the electric wire staking portions, said reinforcing means including a tapered reinforcing portion extending from the engaging surface portion in an axial direction of the tubular part with its radial height gradually reduced.

2. The stopper according to claim 1, wherein the engaging surface portion is confronted with the seal portion, the connecting portion being disposed between the engaging surface portion and the seal portion.

3. The stopper according to claim 2, wherein the tapered reinforcing portion is provided on a side of the engaging surface portion opposite to the other side confronted with the seal portion.

4. The stopper according to claim 1, wherein a radial ridge of the tapered reinforcing portion extends obliquely from an radial end of the engaging surface portion.

5. The stopper according to claim 4, wherein the radial ridge extends substantially parallel to a direction of force exerted onto the engaging surface portion by the electric wire staking portions when the tubular part is pulled in the axial direction thereof.

6. The stopper according to claim 1, wherein the engaging surface portion stands upright with respect to an outer peripheral surface of the connecting portion.

7. A connector, comprising:

a connector housing;

a connecting terminal including a staking portion, a wire clamping portion and a coupling portion interconnecting said staking portion and said clamping portion, said staking portion having a diameter greater than said wire clamping portion and said coupling portion having a gradually increasing diameter from said clamping portion to said staking portion; and a waterproofing stopper adapted to be clamped by said staking portion together with a covered wire to seal between the covered wire and an inner wall surface of said connector housing accommodating the electric wire connecting terminal therein, said stopper including a tubular part formed of an elastic material with an electric wire insertion hole extending therethrough, the tubular part including:

a seal portion with an outer surface adapted to be brought into tight contact with the inner wall surface of the connector housing;

a connecting portion adapted to be clamped by said staking portion and an annular engaging rib extending radially outward from an end of said connecting portion and having an outermost end, the annular engaging rib having an engaging surface portion for engagement with said staking portion and means for reinforcing the engagement of the annular engaging surface portion with said staking portion, said reinforcing means including a tapered reinforcing portion extending from an end of the engaging surface portion in an axial direction of the tubular part with its radial height gradually reduced to said outermost end.

* * * * *